US011322887B2

(12) United States Patent
Hsu et al.

(10) Patent No.: US 11,322,887 B2
(45) Date of Patent: May 3, 2022

(54) PLUG CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yang-Tsun Hsu, New Taipei (TW); Jun Chen, Kunshan (CN); Fan-Bo Meng, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/014,292

(22) Filed: Sep. 8, 2020

(65) Prior Publication Data

US 2021/0075158 A1 Mar. 11, 2021

(30) Foreign Application Priority Data

Sep. 9, 2019 (CN) ..... 201910865009.1

(51) Int. Cl.
*H01R 12/79* (2011.01)
*H01R 13/627* (2006.01)
(Continued)

(52) U.S. Cl.
CPC ..... *H01R 13/6275* (2013.01); *H01R 12/79* (2013.01); *H01R 13/6335* (2013.01); *H01R 43/20* (2013.01)

(58) Field of Classification Search
CPC ..... H01R 13/639; H01R 13/629; H01R 13/62933; H01R 13/62905;
(Continued)

(56) References Cited

U.S. PATENT DOCUMENTS 7,473,124 B1 * 1/2009 Briant ..... H01R 13/6275 439/352
2008/0032541 A1 * 2/2008 Reed ..... H01R 13/6275 439/352
(Continued)

FOREIGN PATENT DOCUMENTS

CN 207038836 2/2018
CN 208797273 4/2019
CN 110350337 A * 10/2019

*Primary Examiner* — Truc T Nguyen
(74) *Attorney, Agent, or Firm* — Ming Chieh Chang; Wei Hz Chung

(57) ABSTRACT

A plug connector includes an insulative housing, a locking member located at an upper end of the insulative housing, and a pulling tape connected with the locking member, wherein the insulative housing includes an insertion member for the pulling tape to pass through, the pull tape includes a horizontal portion connected with the locking member, a handle portion for manual pulling, and a vertical portion located between the horizontal portion and the handle portion, and the handle portion is operable to pull horizontally backwards to move the locking member downwards to unlock the plug connector from a socket connector.

12 Claims, 7 Drawing Sheets

(51) Int. Cl.
*H01R 13/633* (2006.01)
*H01R 43/20* (2006.01)

(58) Field of Classification Search
CPC ..... H01R 13/62977; H01R 13/62983; H01R 13/631; H01R 13/633; H01R 13/6275; H01R 13/62938; H01R 13/6335; H01R 13/62955; H01R 13/6272; H01R 13/506; H01R 24/64; H01R 13/6273; H01R 12/721; H01R 12/88; H01R 13/6582; H01R 13/635; H01R 13/4223
See application file for complete search history.

(56) References Cited

U.S. PATENT DOCUMENTS

2009/0227133 A1* 9/2009 Zhang ..... G02B 6/4246 439/160
2010/0087084 A1* 4/2010 George ..... H01R 13/6275 439/352
2010/0317218 A1* 12/2010 Wu ..... H01R 13/6275 439/352
2012/0052712 A1* 3/2012 Wang ..... H01R 13/6275 439/352
2012/0164860 A1* 6/2012 Wang ..... G02B 6/4261 439/159
2013/0288507 A1* 10/2013 Zhu ..... H01R 13/6275 439/345
2014/0134898 A1* 5/2014 Wang ..... H01R 13/6275 439/843
2015/0111417 A1* 4/2015 Vanderwoud ..... H01R 13/6335 439/476.1
2018/0081129 A1* 3/2018 Kaga ..... G02B 6/3893

* cited by examiner

PLUG CONNECTOR

BACKGROUND OF THE DISCLOSURE

1. Field of the Disclosure

The present disclosure relates to a plug connector, in particular to a plug connector for easy insertion and removal.

2. Description of Related Arts

China patent No. 208797273U discloses a pull tape unlock type cable connector which includes an insulative housing, a circuit printed board, a cable, a locking member, and a pull tape. The housing is provided with a tape hole on one side close to the cable. One end of the pull tape passes through the pull tape hole and is fixedly connected to an extension portion of the locking member.

Therefore, an improved plug connector is desired.

SUMMARY OF THE DISCLOSURE

Accordingly, an object of the present disclosure is to provide a plug connector for easy insertion and removal.

To achieve the above object, a plug connector comprises an insulative housing; a locking member located at an upper end of the insulative housing; and a pulling tape connected with the locking member, wherein the insulative housing includes an insertion member for the pulling tape to pass through, the pull tape includes a horizontal portion connected with the locking member, a handle portion for manual pulling, and a vertical portion located between the horizontal portion and the handle portion, and the handle portion is operable to pull horizontally backwards to move the locking member downwards to unlock the plug connector from a socket connector.

Other objects, advantages and novel features of the disclosure will become more apparent from the following detailed description when taken in conjunction with the accompanying drawings.

DETAILED DESCRIPTION OF THE PREFERRED EMBODIMENT

Reference will now be made in detail to the embodiments of the present disclosure.

Figure 1:
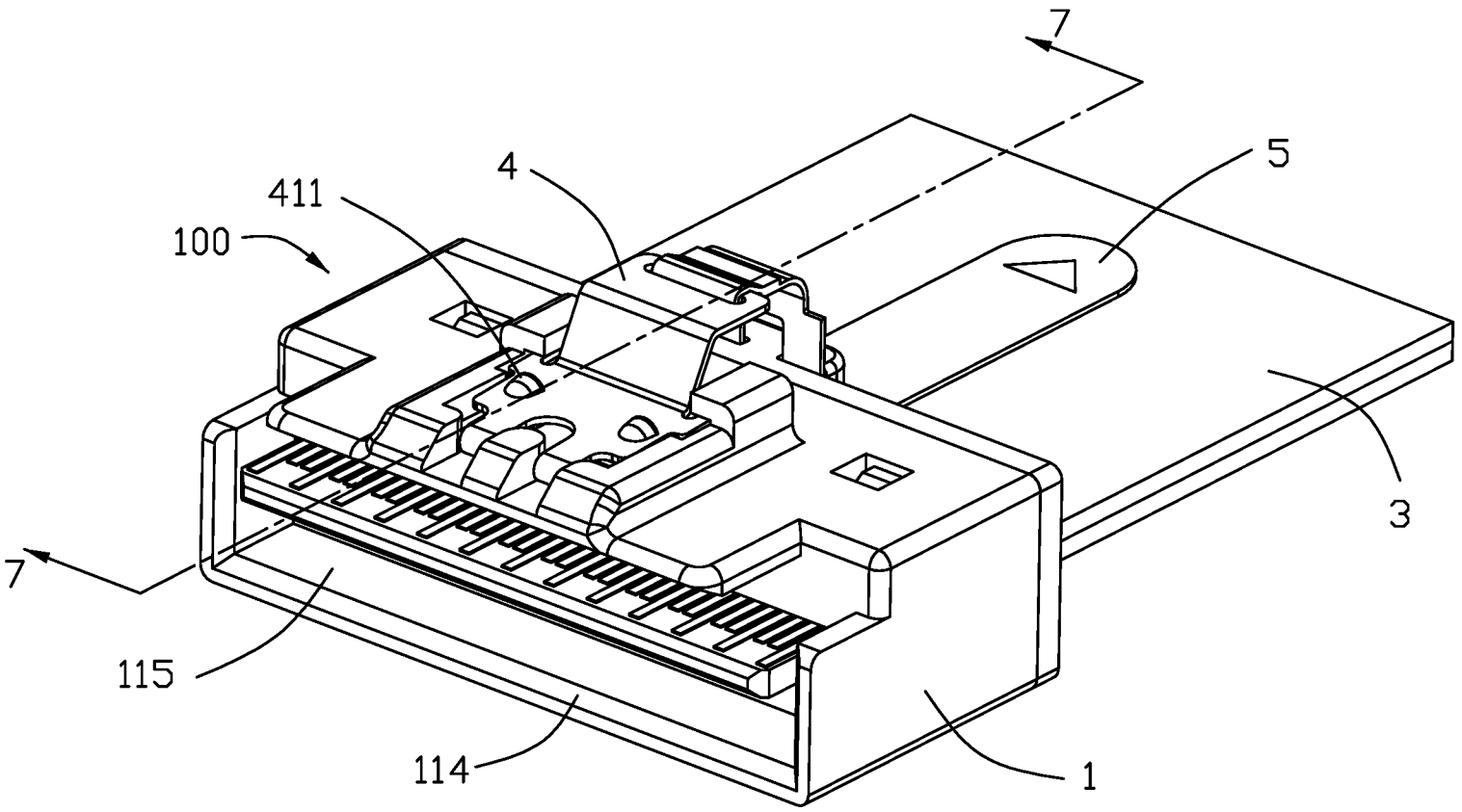
FIG. 1 is a perspective view of a plug connector according to the present invention.
Figure 2:
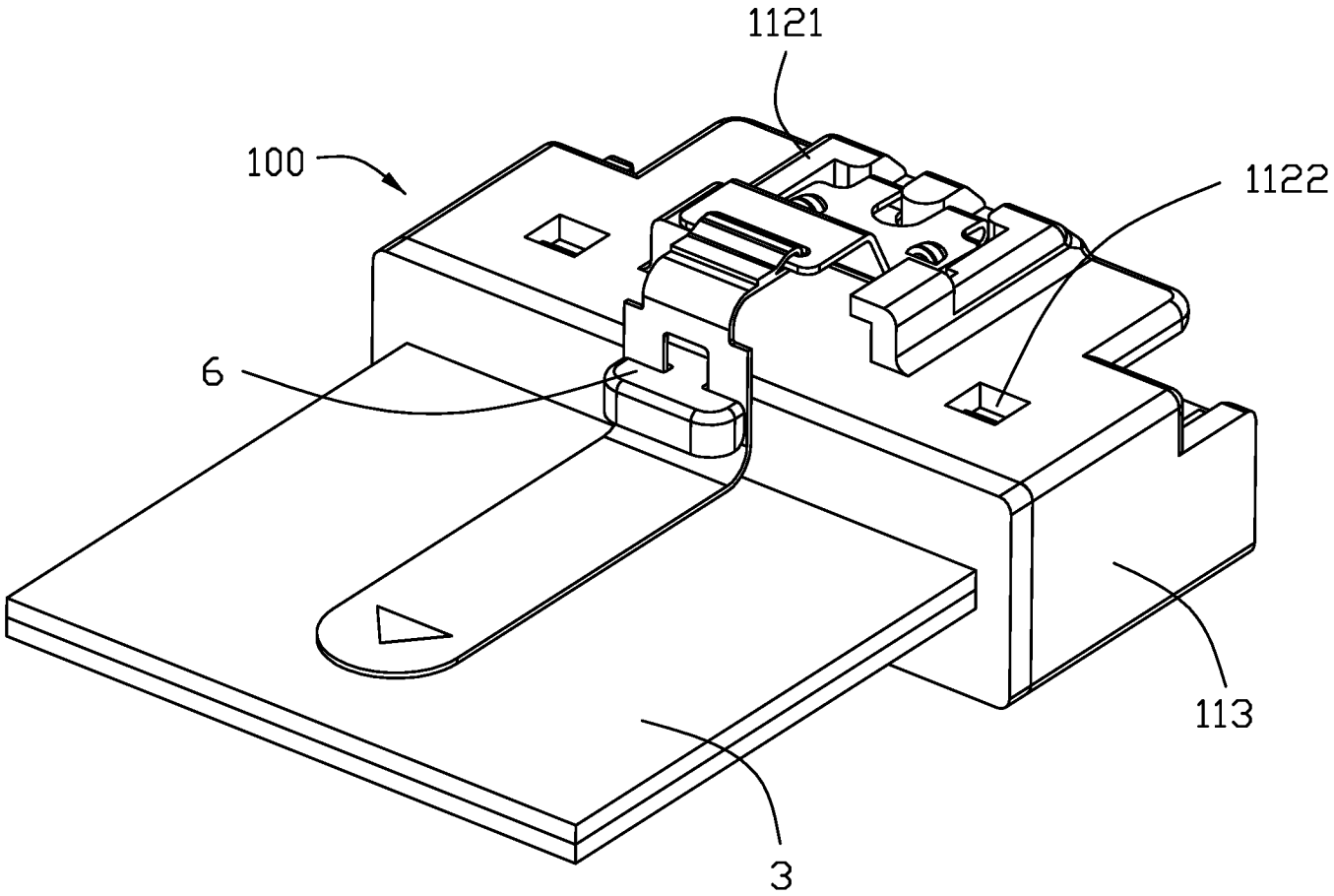
FIG. 2 is another perspective view of the plug connector as shown in FIG. 1.
Figure 3:
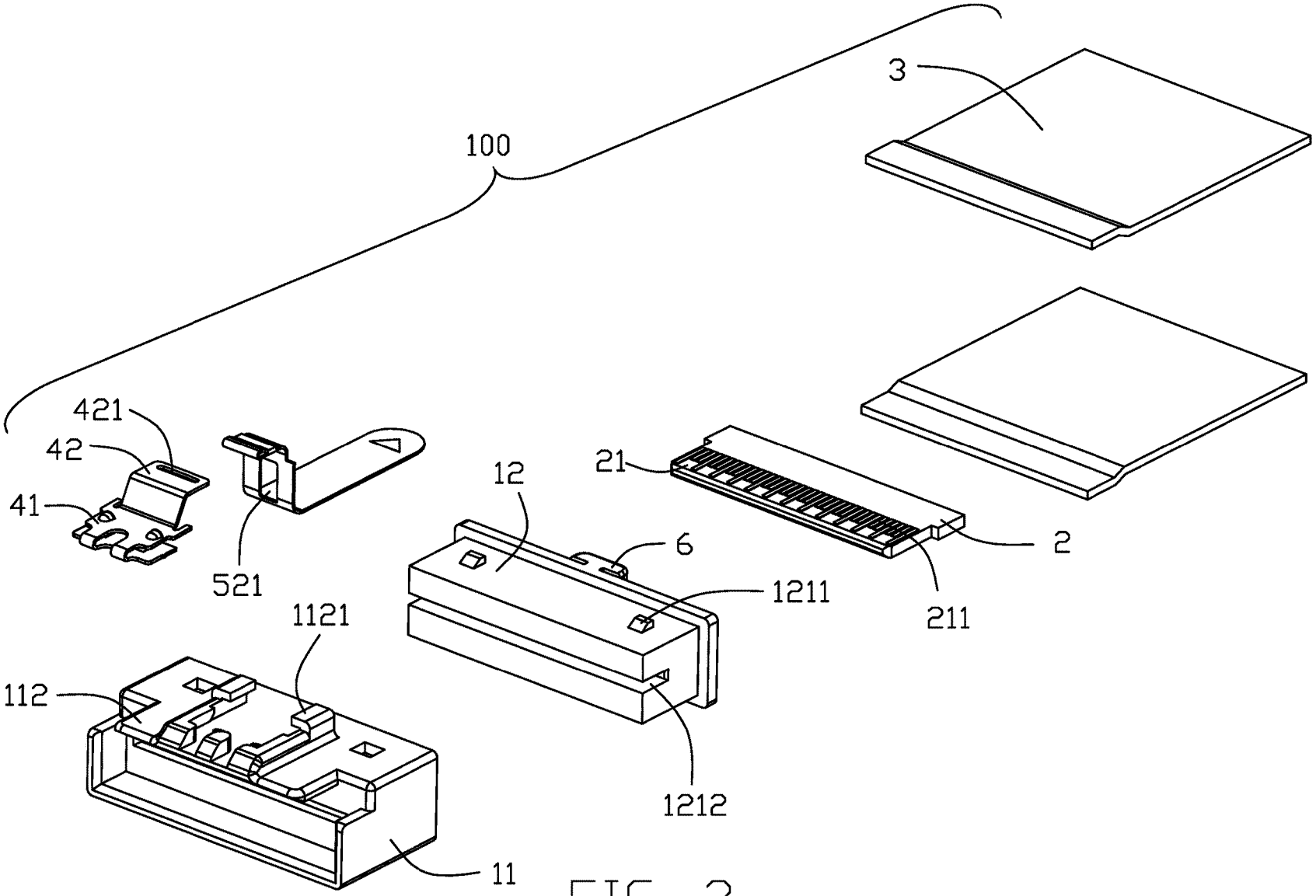
FIG. 3 is exploded view of the plug connector as shown in FIG. 1.
Figure 4:
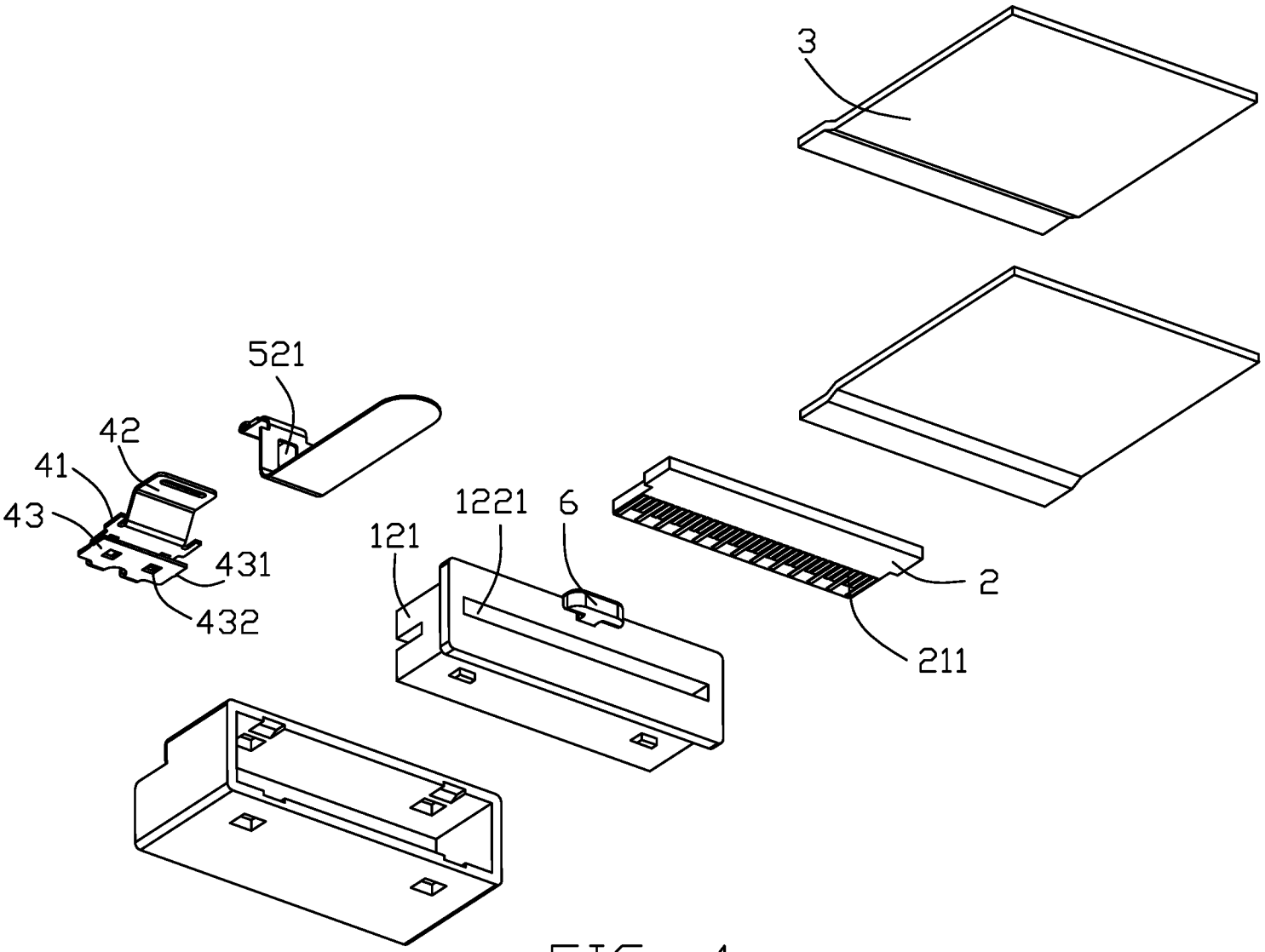
FIG. 4 is another exploded view of the plug connector as shown in FIG. 3.
Figure 5:
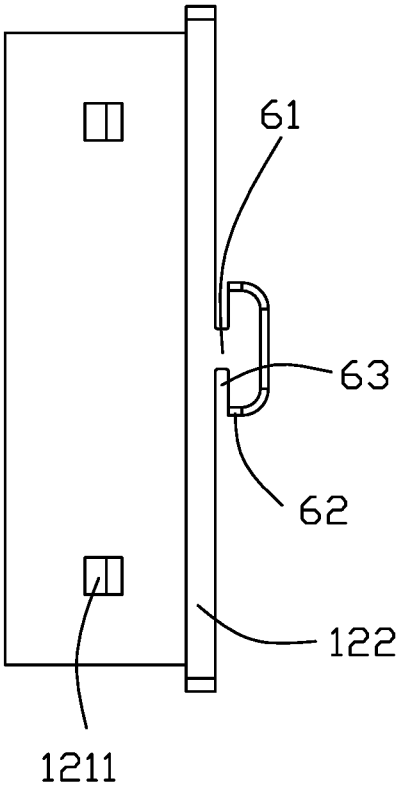
FIG. 5 is a top view of a plug member as shown in FIG. 1.
Figure 6:
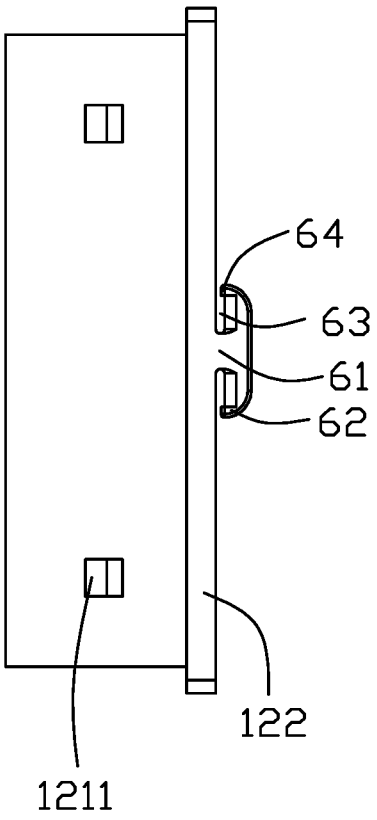
FIG. 6 is a top view of another embodiment of the plug member as shown in FIG. 1.
Figure 7:
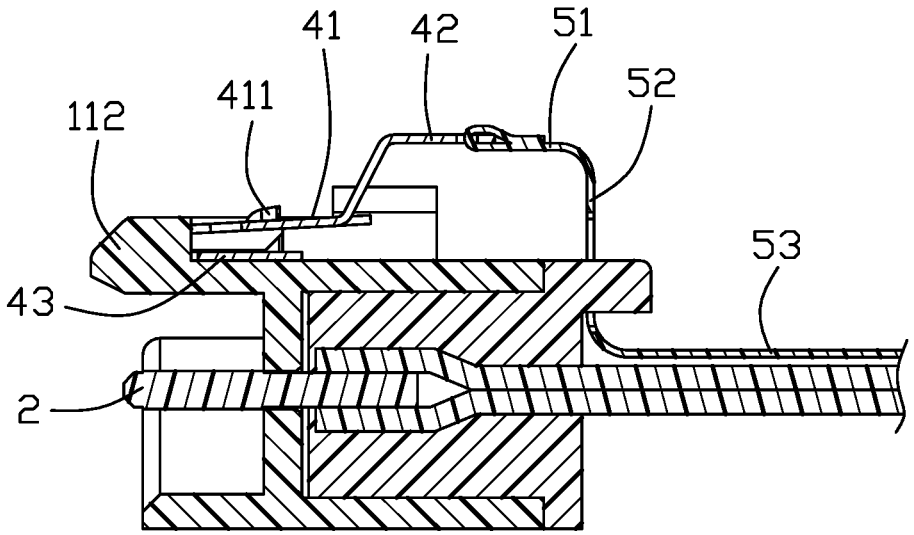
FIG. 7 is a cross-sectional view of the plug connector as shown in FIG. 1.

Referring to FIGS. 1-7, a plug connector 100 used to mate with the socket connector includes an insulative housing 1, a circuit printed board 2 received in the insulative housing 1, a cable 3 electrically connected with the circuit printed board 2, a locking spring member 4, a pull tape 5 connected with the locking spring member 4 and an insertion member 6 disposed on the rear end of the insulative housing 1.

The insulative housing 1 includes a front housing 11 and a rear housing 12 assembled with the front housing 11. The front housing 11 includes a body portion 111, a mating portion 112 protruding forward from the body portion 111, a pair of side baffle plates 113 on the left and right sides of the body portion 111, a lower baffle plate 114 located on the lower side of body portion 111, an opening 115 at the front end of the body portion 111 and a passage 116 communicating with opening 115. The upper end of the mating portion 112 is provided with a step 1121 for fixing the locking spring member 4 and square holes 1122 located on both sides of the step 1121. The rear housing 12 includes a front end 121 and a rear wall 122 located behind the front end 121. The front end 121 is U-shaped and includes blocks 1211 matched with the square holes 1122 and the groove 1212 for the circuit printed board 2 to pass through. The rear wall 122 includes a transverse groove 1221 communicating with the groove 1212.

The circuit printed board 2 passes through the transverse groove 1221 and is inserted into the rear housing 12. The circuit printed board 2 includes an insertion portion 21 extending out of the opening 115. The upper and lower surfaces of the insertion portion 21 are provided with a plurality of metal plates or pads 211 functioning as mating contacts.

The front end of the cable 3 is connected to the upper and lower surfaces of the circuit printed board 2, and the rear end extends backwards out of the insulative housing 12.

The locking spring member 4 is forwardly assembled upon the top face of the housing and includes downwardly deflectable part having an elastic piece 41 moveable around the step 1121 and a connecting piece 42 provided at the rear end of the elastic piece 41, and an immovable retaining section 43 having barbs 431 on two sides and locking holes 432 therein to secure the locking spring member 4 upon the housing 1. The upper surface of the elastic piece 41 is provided with a locking protrusion 411 for cooperating with the locking hole of the socket connector. The elastic piece 41 can drive the locking protrusion 411 to swing elastically up and down. The connecting piece 42 is provided with a positioning hole 421 for connecting with the pulling tape 5.

The pull tape 5 includes a horizontal portion or a front section 51, connected with the locking spring member 4 at one end, a handle portion or a rear section 53 at the other end for manual pulling, and a vertical portion or a middle section 52 located between the horizontal portion 51 and the handle portion 53. The horizontal portion 51 passes through the positioning hole 421 to form a closed ring to realize the connection with the locking spring member 4. The vertical portion 52 includes a tape hole 521 for the insert 6 to pass through. Wherein the width of the tape hole 521 is smaller than the width of the connecting portion 62. Pulling the pull tape 5 horizontally backwards drives the locking spring member 4 to move downwards to unlock the plug connector 100 and the socket connector.

The insertion member 6 is integrally formed with the rear housing 12 and is located on the upper side of the transverse groove 1221. The insertion member 6 includes an extension portion 61 extending rearward from the rear wall 122, a connecting portion 62 extending in the left and right direction from both ends of the extension portion 61, and a limiting groove 63 located between the rear wall 122 and the connecting portion 62. Therefore, in a top view the insertion member 6 forms a T-shaped structure. The insertion member 6 further includes chamfers 64 extending into the limiting groove and respectively located on both sides of the connecting portion in another embodiment of the present invention. By arranging the insertion member 6 on the insulative housing 1, the direction of pulling tape 5 is converted from vertical downward to horizontal backward to facilitate the user to pull out. Understandably, it is desired to have the chamfered structure on a lower sides of the connecting portion 62 so as to smoothly convert the rearward horizontal movement of the pull tape 5 to the downward movement of the pull tape 5 during rearwardly pulling the pull tape 5 for unlocking the plug connector 100 from the complementary receptacle connector.

Notably, one feature of the invention is to have the tape/through hole 521 being of a rectangular configuration with a long side dimensioned larger than the transverse dimension of the connecting portion 62 and a short side dimensioned larger than the vertical dimension of the connecting portion 62 so as to allow the connecting portion 62 to forwardly pass through the tape hole 521 when the pull tape 5 is arranged to extend in a transverse direction and in a horizontal position during assembling the pull tape 5 to the rear housing 12. Understandably, once the connecting portion 62 passes through the tape hole 521 and the extension portion 61 is located in the tape hole 521, the pull tape 5 is rotated from the horizontal position to a vertical position.

On one hand, because the dimension of the connecting portion 62 in the transverse direction is much larger than that of the short side of the tape hole 521, there is no possibility for the pull tape 5 to rearwardly escape from the insertion member 6 in the front-to-back direction. On the other hand, because the extension portion 61 is received within the tape hole 521, there is no possibility for the pull tape 5 to escape from the insertion member 6 in the transverse direction or the vertical direction. Therefore, when the rear end of the pull tape 5 is pulled rearwardly, the pull tape 5 will move relative to the insertion member 6 with the extension portion 61 relatively move within/along the tape hole 521. It is also noted that when assembled, the extension portion 61 is snugly received within the tape hole 521 in the transverse direction, thus assuring no improper tilting of the pull tape 5 with regard to the insertion member 6 but essentially in a vertical position in a rear view.

When the plug connector 100 is mated with the socket connector, the plug connector 100 is inserted forward into the opening of the socket connector until the metal plates 211 of the circuit printed board 2 is electrically connected to the conductive terminals of the socket connector, while the locking protrusion 411 of the elastic piece 41 protrudes into the locking hole of the socket connector. When the plug connector 100 and the socket connector are unlocked, the external force pulls the pull tape 5 horizontally, so that the entire connecting piece 42 inclines downwards, and drives the locking protrusion 411 to move downwards, thereby exiting the locking hole of the socket connector, and releasing the lock between the plug connector 100 and the socket connector. When the external force is removed, under the action of the elastic restoring force of the connecting piece 42 itself, the locking protrusion 411 returns to its original position.

What is claimed is:

1. A plug connector comprising:

an insulative housing;

a locking member located at an upper end of the insulative housing; and a pulling tape connected with the locking member, wherein the insulative housing includes an insertion member extending through the pulling tape, the pull tape includes a horizontal portion connected with the locking member, a handle portion for manual pulling, and a vertical portion located between the horizontal portion and the handle portion, and the handle portion is operable to pull horizontally backwards to move the locking member downwards to unlock the plug connector from a socket connector;

the insertion member includes an extension portion extending rearward from the insulative housing, a connecting portion extending in the left and right direction from both ends of the extension portion to form a limiting groove; and the vertical portion of the pull tape is provided with a tape hole passing through the insertion member.

2. The plug connector as claimed in claim 1, wherein both sides of the connecting portion are respectively provided with chamfers extending into the limiting groove.

3. The plug connector as claimed in claim 1, wherein a width of the tape hole is smaller than a width of the connecting portion.

4. The plug connector as claimed in claim 1, wherein the insulative housing includes a front housing and a rear housing assembled with the front housing.

5. The plug connector as claimed in claim 4, wherein the insertion member is integrally formed with the rear housing.

6. The plug connector as claimed in claim 1, wherein the locking member includes an elastic piece fixed on an upper end of the insulative housing and a connecting piece arranged at a rear end of the elastic piece.

7. The plug connector as claimed in claim 6, wherein an upper surface of the elastic piece is provided with a locking protrusion for matching with a locking hole of the socket connector.

8. The plug connector as claimed in claim 6, wherein the connecting piece is provided with a positioning hole, and the horizontal portion passes through the positioning hole to form a closed ring for connection with the elastic piece.

9. A plug connector comprising:

an insulative housing having a top face and a rear face;

a plurality of mating contacts located in the housing;

a locking member retained upon the top face and including a downwardly deflectable part having a locking protrusion in a front portion thereof and a connecting piece at a rear free end thereof;

an insertion member unitarily formed on the rear face and including an extension portion extending rearwardly from the rear face in a front-to-back direction and a connecting portion located at a rear end of the extension portion and extending in a transverse direction perpendicular to the front-to-back direction; and a flexible pull tape having a front section connected to the connecting piece, a rear section, and a middle section between the front section and the rear section, the middle section having a through hole; wherein the middle section is positioned in a gap defined between the rear face of the housing and the connecting portion in the front-to-back direction;

the extension portion is received within the through hole in a relatively moveable manner;

the through hole is rectangular with a long side and a short side;

a dimension of the long side is larger than a transverse dimension of the connecting portion in the transverse direction, and a dimension of the short side is larger than a vertical dimension of the connecting portion in a vertical direction perpendicular to both the transverse direction and the front-to-back direction; and a dimension of the short side is larger than both a vertical dimension of the extension portion in the vertical direction and a transverse dimension of the extension portion in the transverse direction so as to allow the pull tape to be rotated with about ninety degrees with regard to the insertion member during assembling the pull tape to the housing.

10. The plug connector as claimed in claim 9, wherein a lower side of the connecting portion forms a chamfered structure so as to smoothly convert a rearward horizontal movement of the pull tape around the rear section to a downward vertical movement of the pull tape around the insertion member.

11. The plug connector as claimed in claim 9, wherein the insertion member defines a T-shaped structure in a top view along a vertical direction perpendicular to both the transverse direction and the front-to-back direction.

12. A method of making a plug connector comprising steps of:

providing an insulative housing with a top face and a rear face wherein a T-shaped insertion member is unitarily formed on the rear face;

providing mating contacts in the housing;

forwardly assembling a metallic locking member upon the top face along a front-to-back direction wherein the metallic locking member includes a downwardly deflectable part with a locking protrusion thereon and a connecting piece at a rear end thereof; and assembling a flexible pull tape to both the housing and the locking member wherein the pull tape includes a front section connected to the connecting piece of the locking member, a rear section adapted to be grasped by a user, and a middle section in which a through hole is formed; wherein the middle section is located between the T-shaped insertion member and the rear face in the front-to-back direction;

the T-shaped insertion member includes an extension portion rearwardly extending from the rear face of the housing, and a connecting portion formed at a rear end of the extension portion and extending in a transverse direction perpendicular to the front-to-back direction, and the through hole is rectangular with a long side dimensioned larger than a transverse dimension of the connecting portion in the transverse direction, and a short side dimensioned larger than a vertical dimension of the connecting portion in a vertical direction perpendicular to both the front-to-back direction and the transverse direction;

a dimension of the short side of the through hole is larger than both a vertical dimension of the extension portion in the vertical direction and a transverse dimension of the extension portion in the transverse direction; and the step of assembling includes horizontally positioning the pull tape to align the long side of the through hole with the connecting portion in the transverse direction and successively passing the connecting portion through the through hole in the front-to-back direction to receive the extension portion within the through hole, and finally rotating the pull tape about ninety degrees to have the through hole extend in the vertical direction so the connecting portion prevents a backward movement of the pull tape.

* * * * *